US010905240B2

(12) United States Patent
Bowser

(10) Patent No.: US 10,905,240 B2
(45) Date of Patent: Feb. 2, 2021

(54) SUPPORT BRACKET FOR COUNTERTOPS AND SHELVING

(71) Applicant: William T. Bowser, Clay Township, MI (US)

(72) Inventor: William T. Bowser, Clay Township, MI (US)

( * ) Notice: Subject to any disclaimer, the term of this patent is extended or adjusted under 35 U.S.C. 154(b) by 129 days.

(21) Appl. No.: 16/106,766

(22) Filed: Aug. 21, 2018

(65) Prior Publication Data

US 2019/0059586 A1 Feb. 28, 2019

Related U.S. Application Data

(60) Provisional application No. 62/549,765, filed on Aug. 24, 2017.

(51) Int. Cl.
*A47B 96/06* (2006.01)
*A47B 5/00* (2006.01)

(52) U.S. Cl.
CPC ..... *A47B 96/067* (2013.01); *A47B 5/00* (2013.01); *A47B 96/061* (2013.01); *A47K 2201/02* (2013.01)

(58) Field of Classification Search
CPC ..... A47B 96/067; A47B 5/00; A47B 96/061; A47K 2201/02
USPC ..... 248/205.1, 447.1, 48.1, 281.11
See application file for complete search history.

(56) References Cited

U.S. PATENT DOCUMENTS

| | | | | | |
|---|---|---|---|---|---|
| 3,185,426 | A * | 5/1965 | Bjerke | A47B 96/061 | 248/250 |
| 3,494,582 | A * | 2/1970 | Nemeth | A47B 96/061 | 211/107 |
| 3,523,393 | A * | 8/1970 | Sand | A47B 96/061 | 248/235 |
| 4,930,738 | A * | 6/1990 | Lombardo | A47G 29/00 | 248/205.1 |
| 5,624,045 | A * | 4/1997 | Highsmith | A47B 57/487 | 211/191 |
| 2008/0017772 | A1* | 1/2008 | Wooten | A47B 96/061 | 248/248 |
| 2009/0114785 | A1* | 5/2009 | Huang | H05K 7/1489 | 248/220.31 |
| 2012/0006957 | A1* | 1/2012 | Kluge | A47B 96/1466 | 248/224.8 |
| 2018/0245356 | A1* | 8/2018 | Muth | F16B 2/12 | |
| 2019/0059586 | A1* | 2/2019 | Bowser | A47B 5/00 | |

* cited by examiner

*Primary Examiner* — Muhammad Ijaz

(57) ABSTRACT

In a first embodiment, a wall mount bracket including an elongated cantilevered support arm and spaced apart mounting plates are used to secure a countertop thereatop. Alternately, the elongated arm cooperates with a mounting area for use with a kitchen island or similar mounting. The cantilevered arms define floating arms which are readily mounted to support structures.

1 Claim, 3 Drawing Sheets

SUPPORT BRACKET FOR COUNTERTOPS AND SHELVING

CROSS-REFERENCE TO RELATED APPLICATIONS

This application is a completion application of U.S. patent application Ser. No. 62/319,765, filed Aug. 24, 2017, for a SUPPORT BRACKET FOR COUNTERTOPS AND SHELVING, the entire disclosure of which is hereby incorporated by reference in its entirety.

BACKGROUND OF THE INVENTION

1. Field of the Invention

The present invention concerns mounting brackets. More particularly the present invention concerns mounting brackets for facilitating installation of cabinetry. Even more particularly the present invention concerns mounting brackets for use in conjunction with cabinetry and methods of installation therefor.

2. Description of Related Art

It is known in the art relating to cabinetry to use brackets that are affixed along a wall in a generally level and spaced apart fashion to support cabinetry and their accoutrements. For example, it is known to support a kitchen or bathroom counter or countertop with brackets that are mounted flush with a wall surface, or to mount the countertop on top of a cabinet or set of cabinets. However, such conventional countertop bracketry may be difficult to install and may not support a heavy load.

The present invention, as described hereinafter provides improved bracketry which is easily installed and which can support a heavy load.

SUMMARY OF THE INVENTION

In a first embodiment hereof there is provided a bracket for installation below a countertop for supporting same. The bracket includes an elongated channeled member having a top wall, a downwardly depending sidewall and an opposed pair of flanges provided on the opposite side of the sidewall, which provide access to the bracket interior or interior channel.

A pair of opposed downward depending plate elements are positioned rearwardly of the channel member to define means for mounting the bracket to a wall stud or the like.

In use the bracket of this embodiment is installed with a pair of spaced apart brackets. The countertop sits flush atop the pair of spaced apart brackets.

The channel can be used for retaining electrical wires or the like therein.

Fasteners, such as screws or the like can be used to secure a countertop thereto.

In a second embodiment hereof there is provided a bracket for use with "island" cabinetry of the type typically found in kitchens or similar environments. The bracket includes an elongated channel member having a top wall and pair of opposed downwardly depending, spaced apart sidewalls.

A mounting for the bracket is defined by a pair of spaced apart plates. The plates are dimensioned to mate with or seat a wall stud thereatop.

Fasteners, such as screws or the like can be used to secure a countertop thereto.

For a more complete understanding of the present invention reference is made to the following detailed description and accompanying drawing. In the drawing like reference characters refer to like parts throughout the several views in which:

DETAILED DESCRIPTION OF THE INVENTION

Figure 1:
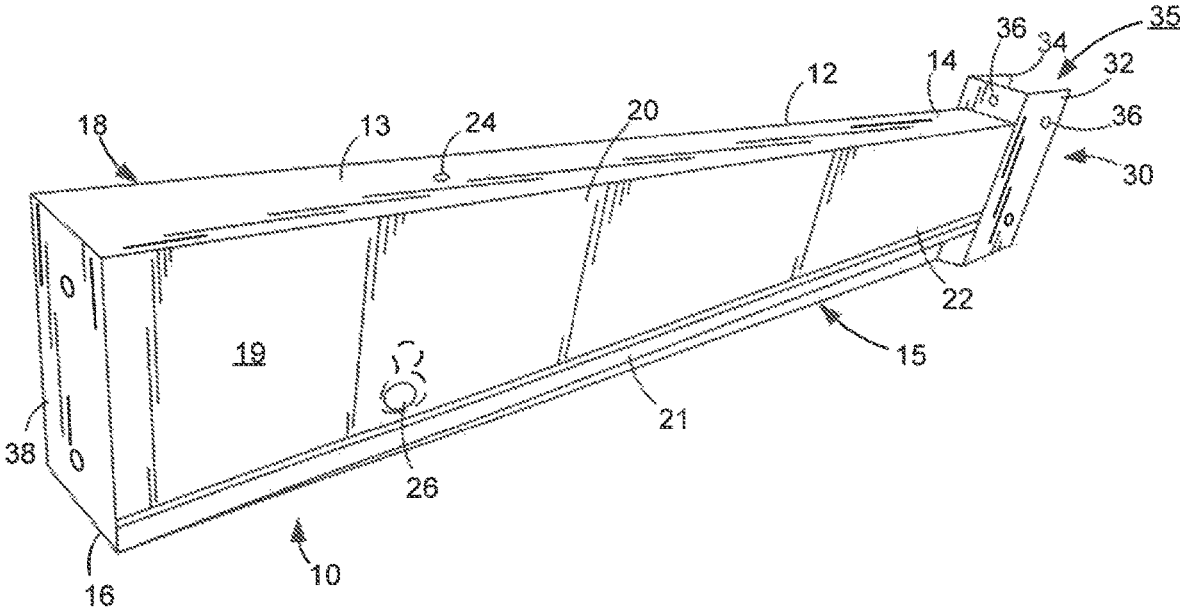
FIG. 1 is a perspective view of a countertop support bracket in accordance with a first embodiment of the present invention.
Figure 2:
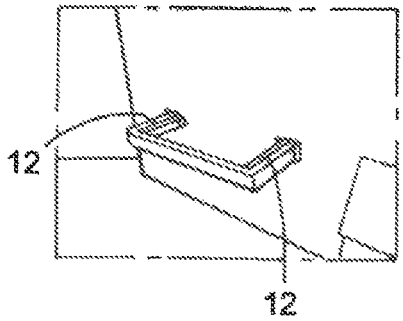
FIG. 2 is an environmental view showing an installation using the countertop support bracket.

Referring now to FIGS. 1 and 2 there is depicted therein a countertop support bracket, generally, denoted at 10 in accordance with this embodiment.

The bracket 10 includes an elongated arm 12 having an upper surface or top wall 13, a bottom wall 15, an inner end 14, an opposite outer end 16, a first sidewall 18, and a second side wall 19 and a pair of opposed flanges 20,21.

At least one aperture 24 extends through the upper surface 13 of the arm 12.

Optionally, at least one aperture 26 may extend through the first sidewall of the arm 12.

The aperture 26 is used to fasten a support, such as 2"×4" to the bracket as shown in FIG. 2.

Referring again to FIG. 1 a U-shaped mount 30 extends rearwardly from the inner end 14 of the elongated arm 12. The mount includes a pair of spaced apart plates 32, 34 which define a gap therebetween and an intermediate plate 35 fixed to end 14 of the arm 12 that can envelop or enshroud a wall stud (not shown) to mount the support bracket thereto. Each plate 32,34,35 includes a plurality of apertures 36, through which fasteners (not shown) may be inserted to secure the mount to the sides of the wall stud. Each aperture 36 in one of the plates 32 or 34 registers with one of the apertures in the other of the plates.

The elongated arm may optionally include an apertured front plate 38 that is disposed between the first and second sides of the arm at the outer end of the arm. The plate 38 of the arm may include a plurality of spaced apart apertures, as shown.

The open interior an be used to string electrical wiring, conduit or other necessary hardware for constructing the complete cabinet.

As shown in FIG. 2 support system for countertops in accordance with this embodiment includes at least a first and second of the support brackets arranged in a cantilevered and substantially vertically aligned disposition on a pair of spaced apart and vertical wall studs. Framing can then be installed therearound with the countertop seated in position. The first and second support brackets support a countertop seated thereatop.

The support bracket in accordance with the invention may be formed from steel, such as 12 gauge (0.105") cold rolled steel or similar metal.

A powder coat or similar finish also may be applied to the member.

Figure 3:
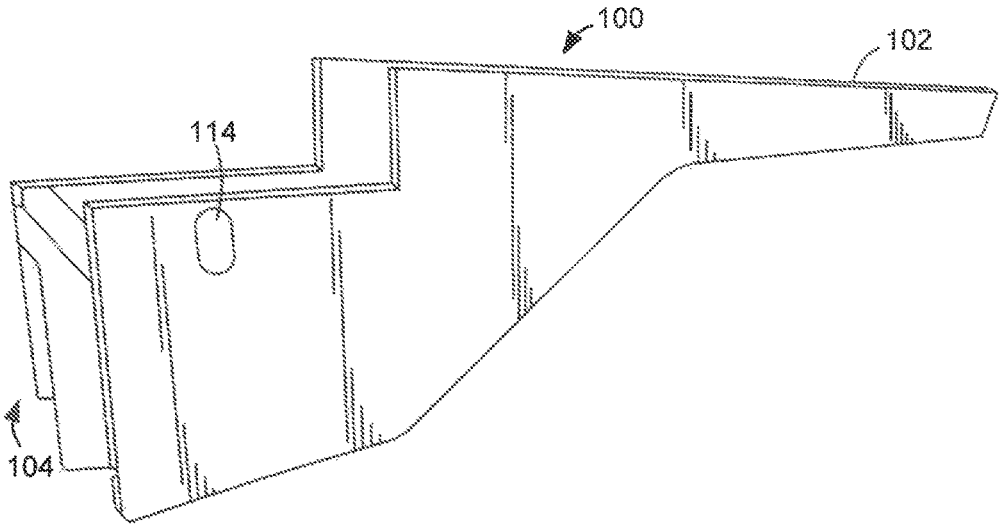
FIG. 3 is a perspective view of an alternate embodiment of a support bracket in accordance with the invention for use with island cabinetry.
Figure 5:
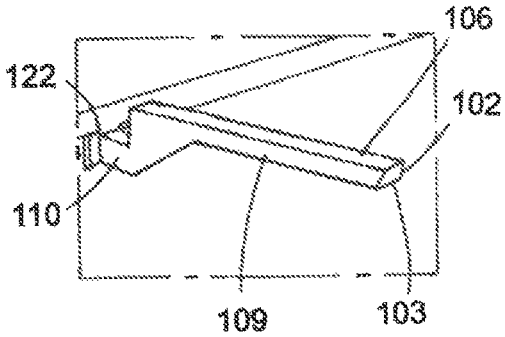
FIG. 5 is an environmental view showing the installation of the bracket of FIG. 3.
Figure 4:
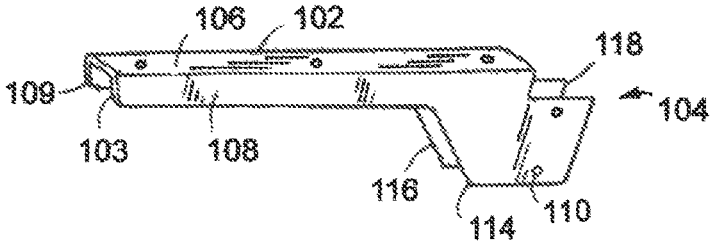
FIG. 4 is a further perspective of the island mount.

Referring now to FIGS. 3-5, there is depicted therein a second embodiment hereof which generally comprises a mounting bracket 100 intended for use with a kitchen type "island." Such islands, as is known to the skilled artisan, are usually centrally located within a kitchen or other area as a stand-alone cooking and or dish washing area.

The mounting bracket 100 hereof generally comprises an elongated arm 102 and a mounting area 104 integrally formed therewith.

As shown in the drawing, the elongated arm 102 comprises a substantially inverted "U" defining a channel 103 and comprising a top wall 106 and a pair of downwardly depending side walls 108,109. A substantially triangular truss 110 is provided on each side or leg of the "U" to provide structural integrity to the bracket.

The mounting area 104 comprises a pair of spaced apart mounting plates 114,116 extending rearwardly from the trusses and provide an open channel 118 which communicates with the channel 103 provided by the elongated arm 102.

The mounting area 104 includes aperture 120 formed in each of the plates (only one of which is shown) and which are in registry to enable fasteners or the like (not shown) to project therethrough for securing the bracket to a suitable support.

The truss 110 is generally disposed at the junction of the mounting area 104 and the arm 102, and at a forward end of the mounting area 104.

The truss 110 has a generally angled, triangular shape, and provides additional support for the cantilevered, elongated arm 102.

As shown in FIG. 5, the mounting area is disposed and formed at a height below that of the elongated arm. The elongated arm and the mounting area cooperate to define the open channeled seating for seating a joist 122 thereon.

It is to be appreciated from the preceding that there has been provided herein a mounting bracket which facilitates construction or floating surfaces that can support virtually any type of material or can have any type of material secured thereto.

Having thus described the invention, what is claimed is:

1. A mounting bracket for securing a structure to a vertical support, comprising:

(a) an elongated arm including a top wall and at least one sidewall, the mounting bracket having an interior channel;

(b) means for mounting the elongated arm to a vertical support the means for mounting comprising a pair of spaced apart mounting plates integral with the elongated arm, the mounting plates being spaced apart and each plate of said pair of mounting plates having at least one aperture, the apertures being in registry for receiving a fastener therethrough to secure the mounting bracket to the vertical support;

(c) a downwardly depending second sidewall integrally formed with the top wall and spaced apart from the at least one sidewall, (d) a bottom wall spaced apart from the top wall;

(e) a pair of opposing flanges one of the pair of opposing flanges extending upwardly from the bottom wall and another one of the pair of opposing flanges extending downwardly from the top wall, the flanges cooperating to define an access to the interior dssssssssssslkaxdmmmmmmmmm channel; and wherein the mounting plates have a height greater than the height of the elongated arm, each of the mounting plates having at least one pair of registering apertures for receiving a fastener therethrough; and further wherein the top wall, bottom wall and sidewall have apertures formed therethrough for securing a framing and countertop thereto.

* * * * *